US011107614B2

(12) United States Patent
Kwon et al.

(10) Patent No.: US 11,107,614 B2
(45) Date of Patent: Aug. 31, 2021

(54) COIL ELECTRONIC COMPONENT

(71) Applicant: SAMSUNG ELECTRO-MECHANICS CO., LTD., Suwon-Si (KR)

(72) Inventors: Soon Kwang Kwon, Suwon-Si (KR); Jung Ho Cho, Suwon-Si (KR); Jung Wook Seo, Suwon-Si (KR); Young Seuck Yoo, Suwon-Si (KR); Joong Won Park, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 440 days.

(21) Appl. No.: 16/117,791

(22) Filed: Aug. 30, 2018

(65) Prior Publication Data

US 2019/0259519 A1 Aug. 22, 2019

(30) Foreign Application Priority Data

Feb. 20, 2018 (KR) ..... 10-2018-0019794

(51) Int. Cl.

| | |
|---|---|
| ***H01F 27/29*** | (2006.01) |
| ***H01F 5/00*** | (2006.01) |
| ***H01F 27/06*** | (2006.01) |
| ***H01F 5/04*** | (2006.01) |
| ***H01F 17/00*** | (2006.01) |

(52) U.S. Cl.

CPC ..... *H01F 5/003* (2013.01); *H01F 5/00* (2013.01); *H01F 5/04* (2013.01); *H01F 17/0013* (2013.01); *H01F 27/06* (2013.01); *H01F 27/29* (2013.01); *H01F 27/292* (2013.01); *H01F 2017/002* (2013.01); *H01F 2027/065* (2013.01)

(58) Field of Classification Search

CPC .... H01F 5/003; H01F 17/0013; H01F 27/292; H01F 27/06; H01F 5/04; H01F 2017/002; H01F 2027/065; H01F 27/2804; H01F 27/29; H01F 2027/2809

See application file for complete search history.

(56) References Cited

U.S. PATENT DOCUMENTS 6,498,553 B1 * 12/2002 Tanaka ..... H01F 5/003 336/183

2017/0011838 A1 1/2017 Asada

FOREIGN PATENT DOCUMENTS

JP 6075505 B2 2/2017
JP 6097921 B2 3/2017

* cited by examiner

*Primary Examiner* — Tuyen T Nguyen

(74) *Attorney, Agent, or Firm* — Morgan, Lewis & Bockius LLP

(57) ABSTRACT

A coil electronic component includes a body, a coil unit disposed in the body and having a multilayer structure. The coil unit includes a first coil pattern forming an upward turn with respect to a bottom surface of the body and a second coil pattern forming a downward turn with respect to the bottom surface of the body. The first and second coil patterns are disposed on at least two layers of the multilayer structure. The component additionally includes a first external electrode and a second external electrode disposed on the bottom surface of the body.

20 Claims, 4 Drawing Sheets

COIL ELECTRONIC COMPONENT

CROSS-REFERENCE TO RELATED APPLICATION(S)

This application claims the benefit of priority to Korean Patent Application No. 10-2018-0019794 filed on Feb. 20, 2018, in the Korean Intellectual Property Office, the disclosure of which is incorporated herein by reference in its entirety.

BACKGROUND

1. Field

The present disclosure relates to a coil electronic component.

2. Description of Related Art

An inductor corresponding to a coil electronic component is used to remove noise or is used as a component constituting an LC resonant circuit. An inductor may be variously classified as a stacked-type inductor, a winding-type inductor, a thin film-type inductor, or the like, depending on a form of a coil.

Recently, with a trend for the miniaturization and diversification of functions of electronic products, inductors have been required to be miniaturized and to have improved high current characteristics. Due to such demands for miniaturization and diversification of functions, a use frequency of an inductor is continuously shifted to a high frequency. In a portable device such as a smartphone, an internal circuit may be complicated due to the requirement for high performance. The importance of measures against noise occurring in a circuit is, therefore, further increasing. To implement an inductor that may be used at a high frequency, degradation in a self-resonance frequency (SRF) needs to be prevented. One of the reasons why the SRF is shifted to a low frequency is stray capacitance occurring between a coil pattern and external electrodes.

SUMMARY

An aspect of the present disclosure may provide a coil electronic component suitable for use at a high frequency due to a reduction in stray capacitance occurring between a coil pattern and external electrodes.

According to an aspect of the present disclosure, a coil electronic component may include a body, a coil unit installed in the body and having a multilayer structure, and a first external electrode and a second external electrode disposed on a bottom surface of the body, wherein at least two layers of the coil unit include first coil patterns and second coil patterns, respectively, the first coil pattern forming an upward turn with respect to the bottom surface of the body, and the second pattern forming a downward turn with respect to the bottom surface.

The first coil pattern may be connected to a first coil pattern disposed on another adjacent layer by a first conductive via.

A lowermost first coil pattern of the first coil patterns may be connected to the first external electrode by the first conductive via.

A lowermost layer of the coil unit having the multilayer structure may only include the first coil pattern.

The second coil pattern may be connected to a second coil pattern disposed on another adjacent layer by a second conductive via.

A lowermost second coil pattern of the second coil patterns may be connected to the second external electrode by the second conductive via.

The first and second conductive vias may be disposed adjacent to each other.

The first and second conductive vias may be disposed in edge regions of the body.

Regions of the first and second coil patterns connected to the first and second conductive vias, respectively, may be bent.

In an uppermost layer of the coil unit having the multilayer structure, the first and second coil patterns may be physically connected to each other.

Each of the first and second coil patterns may form a ½ turn.

The second coil pattern may be disposed in a location adjacent to the first coil pattern in a stacking direction of the coil unit.

The first coil pattern may be disposed in a location adjacent to the second coil pattern in a stacking direction of the coil unit.

The first and second external electrodes may only be disposed on the bottom surface of the body.

The body may include a ferrite component.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Terms used herein are used only in order to describe an exemplary embodiment rather than limiting the present disclosure. In this case, singular forms include plural forms unless interpreted otherwise in context.

Figure 1:
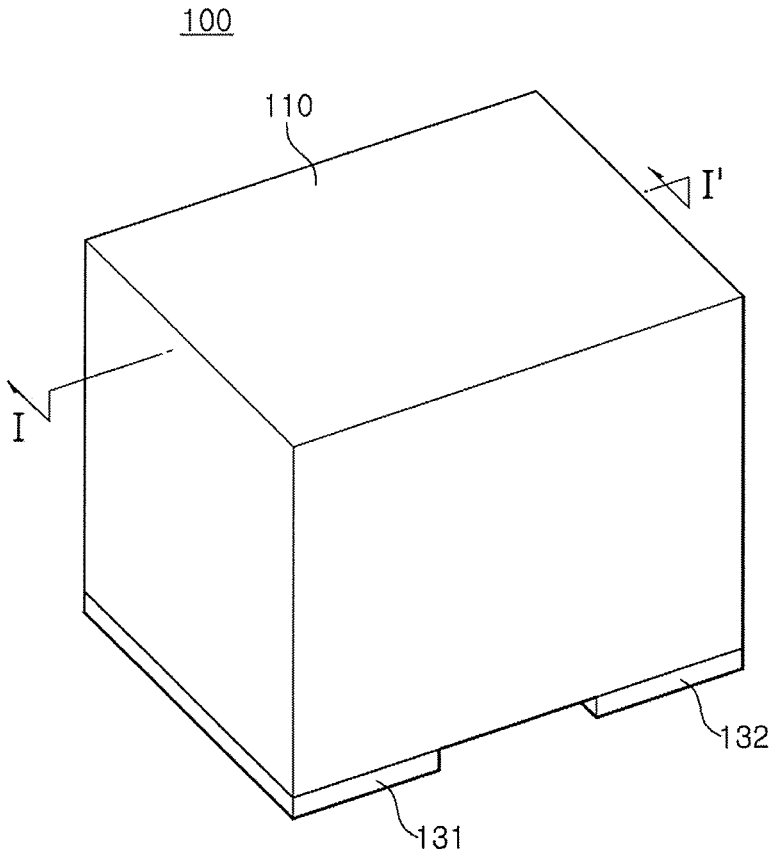
FIGS. 1 through 3 are an exterior perspective view, a cross-sectional view, and an exploded perspective view schematically illustrating a coil electronic component according to an exemplary embodiment in the present disclosure, respectively.
Figure 2:
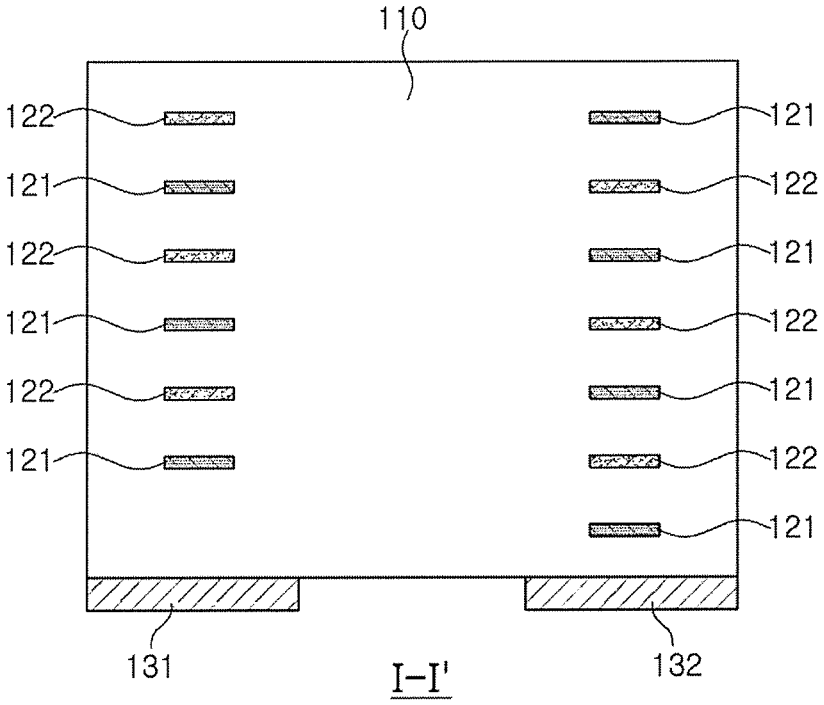
Figure 3:
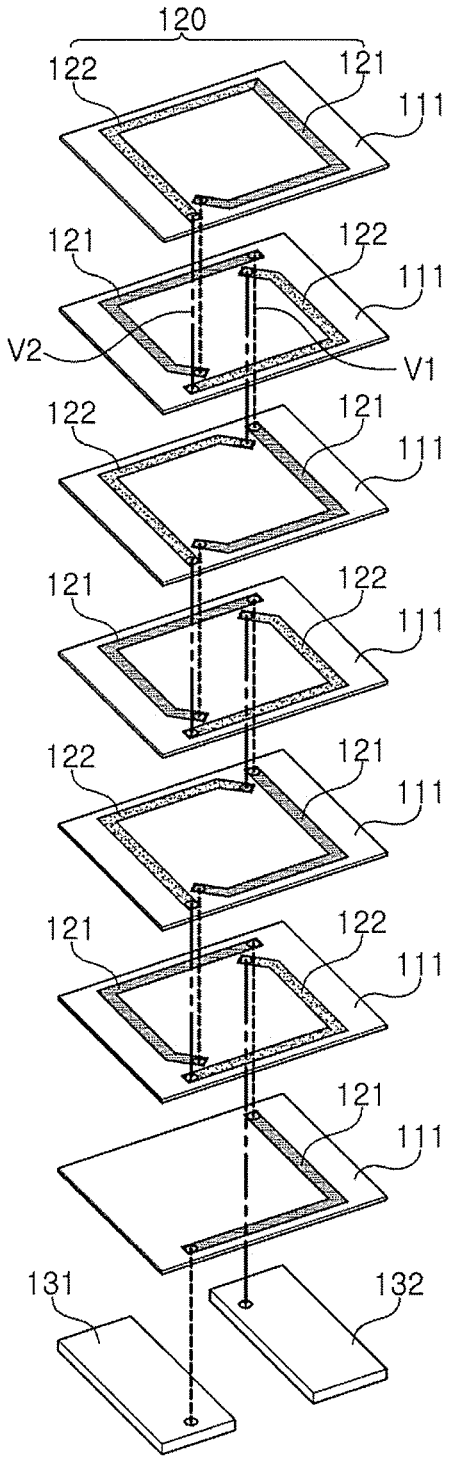
Figure 4:
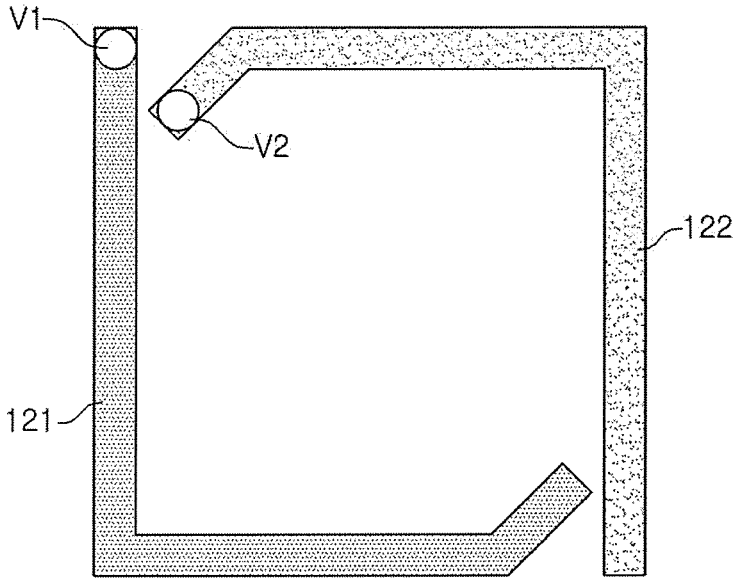
FIGS. 4 and 5 are plan views illustrating shapes of a first coil pattern and a second coil pattern that may be included in some layers in a coil unit having a multilayer structure.
Figure 5:
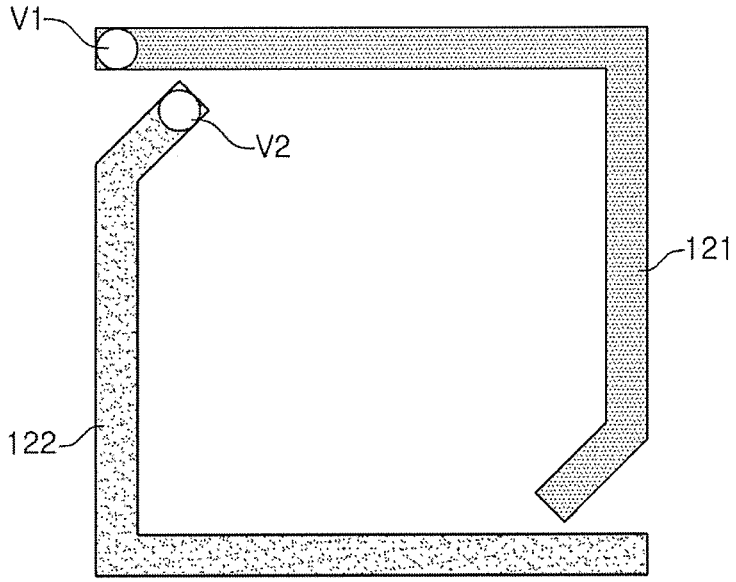

FIGS. 1 through 3 are an exterior perspective view, a cross-sectional view, and an exploded perspective view schematically illustrating a coil electronic component according to an exemplary embodiment in the present disclosure, respectively. In addition, FIGS. 4 and 5 are plan views illustrating shapes of a first coil pattern and a second coil pattern that may be included in some layers in a coil unit having a multilayer structure, to show a connection relationship between adjacent layers in the coil unit.

Referring to the drawings, a coil electronic component 100 may include a body 110, a coil unit 120, a first external electrode 131 and a second external electrode 132. The coil unit 120 having a multilayer structure may include a first coil pattern 121 and a second coil pattern 122 that form turns in different directions. Hereinafter, elements constituting the coil electronic component 100 will be described in detail.

The body 110 may protect the coil unit 120, and the like, and may have electrical insulating properties. As illustrated in FIG. 3, the body 110 may be implemented in a form that a plurality of magnetic layers 111 are stacked, and first and second coil patterns 121 and 122 may be disposed on each of the magnetic layers 111. Considering a magnetic characteristic of the coil electronic component 100, the body 110 may include a magnetic material, for example, ferrite, a metal alloy, and the like. Specifically, the body 110 may include ferrite, and may be implemented in a form of, for example, a ferrite sintered body. The above ferrite may include, for example, Ni—Zn—Cu-based ferrite, Mn—Zn-based ferrite, Ni—Zn-based ferrite, Mn—Mg-based ferrite, Ba-based ferrite, Li-based ferrite, and the like. In addition, the body 110 may have a structure in which magnetic particles formed of a metal, ferrite, and the like, are dispersed in an insulating material, for example, a resin.

The coil unit 120 may be installed in the body 110, and multiple layers of the coil unit 120 may be stacked and electrically connected to another adjacent layer to form a coil structure, as illustrated in the drawings. At least two layers of the coil unit 120 having the multilayer structure may each include first and second coil patterns 121 and 122. In the present exemplary embodiment, six layers of the coil unit 120 may include first and second coil patterns 121 and 122, respectively, and one layer of the coil unit 120 may only include a first coil pattern 121. The number of layers of the coil unit 120 or the numbers of first and second coil patterns 121 and 122 may be changed.

The first and second coil patterns 121 and 122 may be formed by a method of printing conductive paste on a magnetic layer 111, and the like, and may be formed of, for example, materials containing silver (Ag), palladium (Pd), aluminum (Al), nickel (Ni), titanium (Ti), gold (Au), copper (Cu), platinum (Pt), and the like. In addition, to electrically connect a plurality of coil patterns, conductive vias V1 and V2 may be included. Specifically, as illustrated in FIG. 3, the first coil pattern 121 may be connected to a first coil pattern disposed on another adjacent layer by a first conductive via V1, and the second coil pattern 122 may be connected to a second coil pattern disposed on another adjacent layer by a second conductive via V2.

The first and second external electrodes 131 and 132 may be formed outside the body 110 and may be electrically connected to the coil unit 120. A pair of the first and second external electrodes 131 and 132 may be included and connected to one end and the other end of the coil unit 120, respectively, as illustrated in the drawings. The first and second external electrodes 131 and 132 may be formed of materials having high conductivity and may have a multilayer structure. For example, the first and second external electrodes 131 and 132 may include a first layer and a second layer. Here, the first layer may include a sintered electrode obtained by sintering a conductive paste, and the second layer may include at least one plating layer to cover the first layer. In addition, the first and second external electrodes 131 and 132 may include an additional layer, in addition to the first layer and the second layer. For example, the first and second external electrodes 131 and 132 may include a conductive resin electrode between the first layer and the second layer, to alleviate a mechanical shock, and the like.

In the present exemplary embodiment, the first and second external electrodes 131 and 132 may be disposed on a bottom surface of the body 110. Furthermore, the first and second external electrodes 131 and 132 may only be disposed on the bottom surface of the body 110 and may not be disposed on another region, for example, a side of the body 110, and the like. Based on the above structure in which the first and second external electrodes 131 and 132 are disposed on the bottom surface, stray capacitance that may occur between the first and second coil patterns 121 and 122 and the first and second external electrodes 131 and 132 may be minimized. When occurrence of the stray capacitance is minimized as described above, a self-resonance frequency (SRF) may be maintained at a high frequency, and thus the coil electronic component 100 may be beneficially utilized for a removal of high-frequency noise, and the like.

When the first and second external electrodes 131 and 132 are disposed on the bottom surface of the body 110, connections to the first and second coil patterns 121 and 122 may need to be efficiently implemented. This is because when an electrical connection path of the first and second external electrodes 131 and 132 and the first and second coil patterns 121 and 122 increases, stray capacitance may occur between the electrical connection path and a coil pattern, and electrical characteristics may be deteriorated. In the present exemplary embodiment, coil patterns, that is, the first and second coil patterns 121 and 122 that form turns in different directions may be included in each of layers of the coil unit 120, to implement an efficient electrical connection path, which will be described in detail below.

As illustrated in FIG. 3, the first coil patterns 121 may form upward turns with respect to the bottom surface of the body 110. In other words, the first coil patterns 121 may be connected to the first external electrode 131 and may form turns to the top. In this case, a lowermost first coil pattern of the first coil patterns 121 may be connected to the first external electrode 131 by the first conductive via V1. On the other hand, the second coil patterns 122 may form turns in a direction from the top to the bottom of the body 110. In this case, a lowermost second coil pattern of the second coil patterns 122 may be connected to the second external electrode 132 by the second conductive via V2. Meanwhile, to connect the first and second coil patterns 121 and 122 to the first and second external electrodes 131 and 132, respectively, a lowermost layer of the coil unit 120 having the multilayer structure may only include the first coil pattern 121.

The first coil patterns 121 forming the upward turns and the second coil patterns 122 forming the downward turns may be connected in an uppermost part of the body 110, to complete an entire coil structure. In other words, as illustrated in FIG. 3, in an uppermost layer of the coil unit 120 having the multilayer structure, the first and second coil patterns 121 and 122 may be physically connected to each other. First and second coil patterns 121 and 122 disposed in layers of the coil unit 120 other than the uppermost layer thereof may be spaced apart from each other. However, the above physical connection structure of the first and second coil patterns 121 and 122 may not be required to be implemented in only an uppermost layer of the coil unit 120, but may also be implemented in other regions.

As in the present exemplary embodiment, when first and second coil patterns 121 and 122 that form turns in different directions are disposed on the same level, that is, the same magnetic layer 111, a connection path of the conductive vias V1 and V2 may be shortened, and occurrence of stray capacitance by the conductive vias V1 and V2 and the first and second coil patterns 121 and 122 may be minimized.

FIGS. 4 and 5 illustrate, in more detail, shapes of the first and second coil patterns 121 and 122. Referring to FIGS. 4 and 5, each of the first and second coil patterns 121 and 122 may form a ½ turn, and may be alternately disposed in a stacking direction. In other words, based on a stacking direction (that is, a vertical direction based on FIG. 3) of the coil unit 120, the second coil pattern 122 may be disposed in a location adjacent to the first coil pattern 121, and the first coil pattern 121 may be disposed in a location adjacent to the second coil pattern 122.

In addition, to secure a region for a connection to the conductive vias V1 and V2, regions of the first and second coil patterns 121 and 122 connected to the first and second conductive vias V1 and V2, respectively, may be bent. In addition, the first and second conductive vias V1 and V2 may be disposed adjacent to each other as illustrated in FIG. 3, and accordingly, upward turns of the first coil patterns 121 and downward turns of the second coil patterns 122 may be effectively acquired. In addition, the first and second conductive vias V1 and V2 may be disposed in edge regions of the body 110, rather than a central region of the body 110. When a conductive via is disposed in the central region, an interference phenomenon due to a magnetic field of the conductive via may occur, and accordingly, flux may be reduced. In the present exemplary embodiment, the conductive vias V1 and V2 may be disposed in the edge regions, so as to minimize interference by the magnetic field.

As set forth above, a coil electronic component according to the exemplary embodiment in the present disclosure may be stably driven at a high frequency due to a reduction in stray capacitance occurring between a coil pattern and external electrodes.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body;

a coil unit disposed in the body and having a multilayer structure, the coil unit comprising a first coil pattern and a second coil pattern electrically connected to each other, the first and the second coil patterns being disposed on at least two layers of the multilayer structure; and a first external electrode and a second external electrode disposed on a bottom surface of the body, wherein a portion of the first coil pattern and a portion of the second coil pattern are disposed on at least one same layer of the multilayer structure physically disconnected from each other.

2. The coil electronic component of claim 1, wherein a part of the first coil pattern is connected to another part of the first coil pattern disposed on another adjacent layer of the multilayer structure by a first conductive via.

3. The coil electronic component of claim 2, wherein a lowermost part of the first coil pattern is connected to the first external electrode by the first conductive via.

4. The coil electronic component of claim 3, wherein a lowermost layer of the coil unit having the multilayer structure includes only the first coil pattern.

5. The coil electronic component of claim 2, wherein a part of the second coil pattern is connected to another part of the second coil pattern disposed on another adjacent layer of the multilayer structure by a second conductive via.

6. The coil electronic component of claim 5, wherein a lowermost part of the second coil pattern is connected to the second external electrode by the second conductive via.

7. The coil electronic component of claim 5, wherein the first and second conductive vias are disposed adjacent to each other.

8. The coil electronic component of claim 5, wherein the first and second conductive vias are disposed in edge regions of the body.

9. The coil electronic component of claim 5, wherein regions of the first and second coil patterns connected to the first and second conductive vias, respectively, are bent.

10. The coil electronic component of claim 1, wherein in an uppermost layer of the coil unit having the multilayer structure, the first and second coil patterns are physically connected to each other.

11. The coil electronic component of claim 1, wherein each of the first and second coil patterns forms a ½ turn on the at least two layers of the multilayer structure.

12. The coil electronic component of claim 1, wherein the second coil pattern is disposed in a location adjacent to the first coil pattern in a stacking direction of the coil unit.

13. The coil electronic component of claim 1, wherein the first coil pattern is disposed in a location adjacent to the second coil pattern in a stacking direction of the coil unit.

14. The coil electronic component of claim 1, wherein the first and second external electrodes are disposed on only the bottom surface of the body.

15. The coil electronic component of claim 1, wherein the body includes a ferrite component.

16. The coil electronic component of claim 1, wherein the first coil pattern and the second coil pattern are physically connected to each other on at least one layer of the multilayer structure.

17. A coil electronic component, comprising:

a coil unit having a multilayer structure, at least two layers of the multilayer structure each having a first coil pattern and a second coil pattern disposed thereon physically disconnected from each other; and a first external electrode and a second external electrode respectively connected to the first coil pattern and the second coil pattern, the first external electrode and the second external electrode being disposed on a bottom surface of a bottommost layer of the multilayer structure, wherein the first coil pattern and the second coil pattern are electrically connected to each other.

18. The coil electronic component of claim 17, wherein each layer of the multilayer structure is formed of a ferrite composite, the multilayer structure forming a body of the coil electronic component.

19. The coil electronic component of claim 17, wherein the first and second coil patterns are physically connected to each other on at least one layer of the multilayer structure.

20. The coil electronic component of claim 17, wherein, when mounting the coil electronic component on a circuit board, the first and second external electrodes physically contact the circuit board such that the bottom surface of the bottommost layer is disposed closest to the circuit board.

* * * * *